US007253383B2

(12) United States Patent
Park

(10) Patent No.: US 7,253,383 B2
(45) Date of Patent: Aug. 7, 2007

(54) TRANSFORMER ASSEMBLY FOR MICROWAVE OVEN, METHOD FOR MANUFACTURING THE SAME, AND MICROWAVE OVEN HAVING THE SAME

(75) Inventor: Heui Seag Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 285 days.

(21) Appl. No.: 10/691,595

(22) Filed: Oct. 24, 2003

(65) Prior Publication Data

US 2004/0104218 A1 Jun. 3, 2004

(30) Foreign Application Priority Data

Dec. 3, 2002 (KR) ..... 10-2002-0076101
Jan. 28, 2003 (KR) ..... 10-2003-0005620

(51) Int. Cl.
*H05B 6/64* (2006.01)
*H01F 17/00* (2006.01)

(52) U.S. Cl. ..... 219/760; 323/355

(58) Field of Classification Search ..... 219/760, 219/678, 670; 323/355, 361, 358, 362; 336/182, 336/180, 183

See application file for complete search history.

(56) References Cited

U.S. PATENT DOCUMENTS 3,819,899 A 6/1974 Wallin et al.
4,085,395 A 4/1978 Billerbeck et al.
4,593,170 A * 6/1986 Maeda et al. ..... 219/685
4,874,915 A * 10/1989 Harms et al. ..... 219/759
4,954,679 A * 9/1990 Harms et al. ..... 219/687
5,804,959 A * 9/1998 Nakagawa et al. ..... 323/355
6,049,071 A * 4/2000 Le Van Suu ..... 219/715
6,064,048 A * 5/2000 Lim ..... 219/716
6,331,699 B1 * 12/2001 Ito et al. ..... 219/715
6,414,291 B1 * 7/2002 Kim ..... 219/760

FOREIGN PATENT DOCUMENTS

EP 0 783 239 7/1997
EP 1 056 101 11/2000

OTHER PUBLICATIONS

U.S. Appl. No. 10/690,660, filed Oct. 23, 2003, Heui Seag Park.

* cited by examiner

*Primary Examiner*—Daniel Robinson
(74) *Attorney, Agent, or Firm*—Staas & Halsey LLP

(57) ABSTRACT

A transformer assembly for a microwave oven having a magnetron, including a transformer to apply voltage to the magnetron of the microwave oven; a container receiving the transformer therein and having a base plate coupled to the microwave oven and a cover body coupled to the base plate; and a cooling material contained in the container to cool the transformer.

36 Claims, 12 Drawing Sheets

TRANSFORMER ASSEMBLY FOR MICROWAVE OVEN, METHOD FOR MANUFACTURING THE SAME, AND MICROWAVE OVEN HAVING THE SAME

CROSS-REFERENCE TO RELATED APPLICATIONS

This application claims the benefit of Korean Patent Application No. 2002-76101, filed Dec. 3, 2002, and Korean Patent Application No. 2003-5620, filed Jan. 28, 2003, in the Korean Intellectual Property Office, the disclosures of which are incorporated herein by reference.

BACKGROUND OF THE INVENTION

1. Field of the Invention

The present invention relates to a liquid-cooled transformer assembly for microwave ovens, a method for manufacturing the same, and a microwave oven equipped with the same.

2. Description of the Related Art

A conventional transformer for microwave ovens increases a voltage of a power source, and includes a core and primary and secondary windings wound around the core. The transformer is installed in an electrical components area, partitioned from a cooking chamber, together with other electrical components such as a high-voltage capacitor and a cooling fan. The transformer inherently generates heat by resistance of the coils and generation of eddy current due to variation of magnetic flux density of the cores. The heat is removed by a cooling device having a fan and a fan motor in an air-cooling manner.

Because the transformer generates vibration and noise during its operation, the transformer is provided with a separate rubber cushion to overcome the above problems.

Furthermore, because the cooling procedure for the transformer, which involves only air cooling, has a low cooling efficiency, an operational efficiency of the transformer is decreased. Consequently, the components, such as the core and the coils, must be manufactured with large surface areas to compensate for the decrease of operational efficiency, thereby increasing production costs. In addition, because vibration-absorbing elements such as the rubber cushions are required to absorb the vibration and noise, the production cost is further increased.

To prevent noise, rise of temperature, and corrosion of the core, the conventional transformer is immersed in a varnish solution to form a thin film on outer surfaces of the transformer during the manufacturing process, thereby increasing production cost and manufacturing time. Furthermore, because insulating material is required to prevent electric leakage from the transformer mounted on a microwave oven, labor costs are increased.

SUMMARY OF THE INVENTION

It is an aspect of the present invention to provide a transformer assembly for a microwave oven having many advantages, including being efficiently cooled by a cooling material; being miniaturized, lightweight, and having reduced production costs by reducing the sizes of associated components; having improved reliability by reducing vibration and noise during operation; and being efficiently and firmly mounted on a microwave oven with minimal installation space, resulting in miniaturization of the microwave oven and simplification of fabrication.

It is another aspect of the present invention to provide a method for manufacturing the transformer assembly.

It is a further aspect of the present invention to provide a microwave oven having the transformer assembly.

Additional aspects and/or advantages of the invention will be set forth in part in the description that follows and, in part, will be obvious from the description, or may be learned by practice of the invention.

To achieve the above and/or other aspects of the present invention, there is provided a transformer assembly for a microwave oven, including a transformer to apply voltage to the magnetron of the microwave oven; a container receiving the transformer therein and having a base plate coupled to the microwave oven and a cover body coupled to the base plate; and a cooling material contained in the container to cool the transformer.

The cooling material is mineral oil.

The container is maintained in a vacuumed condition at its upper portion.

The container is made of aluminum or copper.

The transformer and the base plate are attached to each other by spot welding.

The cover body and the base plate are attached to each other by brazing.

The base plate includes a base part defining a bottom of the container; extension parts at respective ends of the base part, formed by bending each end of the base part downwardly; and mounting parts at respective ends of the extension parts, formed by bending the end of each extension part outwardly with the base part being separated from the mounting parts, to fasten the base plate to the microwave oven.

The base plate includes a base part defining a bottom of the container; extension parts at respective ends of the base part, formed by bending each end of the base part downwardly; and mounting parts at respective ends of the extension parts, formed by bending the end of each extension part inwardly with the base part being separated from the mounting parts, to fasten the base plate to the microwave oven.

The transformer includes an input line; an output line; a primary winding of the transformer connected to an external power source via the input line; a secondary winding of the transformer to output electric current, transformed by electromagnetic induction induced by the primary winding, to the magnetron via the output line; and a terminal unit attached to the cover body to allow the input line and the output line to be connected to the external power source and the magnetron, respectively.

The terminal unit includes block terminals.

To achieve the above and/or other aspects of the present invention, there is provided a transformer assembly for a microwave oven, including a transformer to apply voltage to the magnetron of the microwave oven; a container receiving the transformer; a cooling material contained in the container to cool the transformer; and a bracket attached to a surface of the container to install the container in the microwave oven.

The transformer, the surface of the container, and the bracket are attached to one another by spot welding.

The container comprises a base plate and a cover body coupled to the base plate by brazing.

The bracket includes a base part attached to the surface of the container; extension parts at respective ends of the base part, formed by bending each end of the base part downwardly; and mounting parts at respective ends of the extension parts, formed by bending the end of each extension part outwardly with the base part being separated from the mounting parts, to fasten the bracket to the microwave oven.

The bracket includes a base part attached to the surface of the container; extension parts at respective ends of the base part, formed by bending each end of the base part downwardly; and mounting parts at respective ends of the extension parts, formed by bending the end of each extension part inwardly with the base part being separated from the mounting parts, to fasten the bracket to the microwave oven.

The transformer includes an input line; an output line; a primary winding of the transformer connected to an external power source via the input line; a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

The terminal unit includes block terminals.

To achieve the above and/or other aspects of the present invention, there is provided a microwave oven including a cooking chamber; an electrical components area isolated from the cooking chamber; a magnetron installed in the electrical components area to generate microwaves into the cooking chamber; a transformer to apply voltage to the magnetron; a container receiving the transformer and having a base plate and a cover body coupled to the base plate; and a cooling material contained in the container to cool the transformer.

The cooling material includes mineral oil.

The container is maintained in a vacuumed condition at its upper portion.

The container is made of aluminum or copper.

The transformer and the base plate are attached to each other by spot welding.

The cover body and the base plate are attached to each other by brazing.

The base plate includes a base part defining a bottom of the container; extension parts at respective ends of the base part, formed by bending each end of the base part downwardly; and mounting parts at respective ends of the extension parts, formed by bending the end of each extension part outwardly with the base part being separated from the mounting parts, to fasten the base plate to the microwave oven.

The base plate includes a base part defining a bottom of the container; extension parts at respective ends of the base part, formed by bending each end of the base part downwardly; and mounting parts at respective ends of the extension parts, formed by bending the end of each extension part inwardly with the base part being separated from the mounting parts, to fasten the base plate to the microwave oven.

The transformer includes an input line; an output line; a primary winding of the transformer connected to an external power source via the input line; a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

The terminal unit includes block terminals.

To achieve the above and/or other aspects of the present invention, there is provided a microwave oven including a cooking chamber; an electrical components area isolated from the cooking chamber; a magnetron installed in the electrical components area to generate microwaves into the cooking chamber; a transformer to apply voltage to the magnetron; a container receiving the transformer; a cooling material contained in the container to cool the transformer; and a bracket attached to a surface of the container to install the container in the machine room.

The transformer, the surface of the container and the bracket are attached to one another by spot welding.

The container includes a base plate and a cover body coupled to the base plate by brazing.

The bracket includes a base part attached to the surface of the container; extension parts at respective ends of the base part, formed by bending each end of the base part downwardly; and mounting parts at respective ends of the extension parts, formed by bending the end of each extension part outwardly with the base part being separated from the mounting parts, to fasten the bracket to the microwave oven.

The bracket includes a base part attached to the surface of the container; extension parts at respective ends of the base part, formed by bending each end of the base part downwardly; and mounting parts at respective ends of the extension parts, formed by bending the end of each extension part inwardly with the base part being separated from the mounting parts, to fasten the bracket to the microwave oven.

The transformer includes an input line; an output line; a primary winding of the transformer connected to an external power source via the input line; a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

The terminal unit includes block terminals.

To achieve the above and/or other aspects of the present invention, there is provided a microwave oven including a transformer assembly having a transformer, a container receiving the transformer, and a cooling material in the container to cool the transformer; and a fastening unit connected to the transformer assembly to install the transformer assembly in the electrical components area of the microwave oven, wherein a distance between a center line of the container and a center line of the fastening unit is less than a distance between the center line of the container and an outer circumferential surface of the container.

The container includes a base part defining a bottom of the container; extension parts at respective ends of the base part, formed by bending each end of the base part downwardly; and mounting parts at respective ends of the extension parts, formed by bending the end of each extension part outwardly with the base part being separated from the mounting parts, wherein the fastening unit fastens the mounting parts to a bottom of the electrical components area.

The transformer assembly includes a bracket attached to a surface of the container, the bracket including a base part attached to the surface of the container; extension parts at respective ends of the base part, formed by bending each end of the base part downwardly; and mounting parts at respective ends of the extension parts, formed by bending the end of each of the extension parts with the base part being separated from the mounting part, wherein the fastening unit fastens the mounting part to a bottom of the electrical components area.

To achieve the above and/or other aspects of the present invention, there is provided a method of manufacturing a transformer assembly for a microwave oven, the transformer assembly having a sidewall, a base plate, a top plate, and a bracket, and a transformer with a coil and a core, the method including coupling an end of the sidewall to the base plate; inserting the transformer into the sidewall and mounting the transformer on the base plate; coupling the top plate to the other end of the sidewall to define a container; and injecting oil into the container.

The coupling of the sidewall to the base plate is performed by brazing.

The mounting of the transformer on the base plate is performed by spot welding.

The coupling of the sidewall to the base plate includes attaching the bracket to the base plate to install the base plate in the microwave oven, and the mounting of the transformer on the base plate includes combining the transformer, the base plate, and the bracket together.

The coupling of the top plate to the sidewall includes installing input lines and output lines, through the top plate, connecting one end of the input lines to an external power source and the other end of the input lines to the transformer, connecting the output lines to the transformer to output electric current transformed by the transformer, and coupling the top plate with the input lines and the output lines installed thereto to the sidewall.

The installation of the input lines and the output lines includes forming a through hole in the top plate, passing the input lines and the output lines through the through hole, and sealing the through hole with epoxy resin.

The installation of the input lines and the output lines includes attaching a terminal unit to the top plate and connecting the input lines and the output lines to the terminal unit.

The injecting of the oil includes forming an oil inlet in the top plate, injecting the oil into the container through the oil inlet, and sealing the oil inlet.

The injecting of the oil includes injecting the oil until a level of the oil is between the top plate of the container and an upper end of the coil of the transformer.

The injecting of the oil includes injecting the oil until a level of the oil is between an upper end of the core of the transformer and an upper end of the coil of the transformer.

The coupling of the base plate to the sidewall is performed by further includes preparing the sidewall having an inner surface with at least two points having different distances from a center of the container.

To achieve the above and/or other aspects of the present invention, there is provided a method of manufacturing a transformer assembly for a microwave oven, the transformer assembly having a sidewall, a base plate, a top plate, and a bracket, and a transformer with a coil and a core, the method including coupling an end of the sidewall to the base plate; inserting the transformer into the sidewall and mounting the transformer on the base plate to define a container; injecting oil into the container defined by the sidewall and the base plate; and coupling the top plate to the other end of the sidewall.

The coupling of the sidewall to the base plate is performed by brazing.

The mounting of the transformer on the base plate is performed by spot welding.

The coupling of the sidewall to the base plate includes attaching the bracket to the base plate to install the base plate in the microwave oven, and the mounting of the transformer on the base plate includes combining the transformer, the base plate, and the bracket together.

The coupling of the top plate to the sidewall includes installing input lines and output lines through the top plate to respectively provide external power to the transformer and output electric current transformed by the transformer, and coupling the top plate with the input lines and the output lines installed thereto to the sidewall.

The installation of the input lines and the output lines includes forming a through hole in the top plate, passing the input lines and the output lines through the through hole, and sealing the through hole with epoxy resin.

The installation of the input lines and the output lines includes attaching a terminal unit to the top plate, and connecting the input lines and the output lines to the terminal unit.

The injecting of the oil includes injecting the oil until a level of the oil is between an upper end of the container and an upper end of the coil of the transformer.

The injecting of the oil includes injecting the oil until a level of the oil is between an upper end of the core of the transformer and an upper end of the coil of the transformer.

The coupling of the sidewall to the base plate further includes preparing the sidewall having an inner surface with at least two points having different distances from a center of the container.

BRIEF DESCRIPTION OF THE DRAWINGS

These and/or other aspects and advantages of the invention will become apparent and more readily appreciated from the following description of the preferred embodiments, taken in conjunction with the accompanying drawings, of which:

FIGS. 2A through 2D and FIGS. 3A through 3C are cross-sectional views showing various structures for mounting the transformer assembly of FIG. 1A to a microwave oven;

FIG. 4B is a flowchart showing another process of manufacturing the transformer assembly.

DETAILED DESCRIPTION OF THE PREFERRED EMBODIMENTS

Figure 1A:
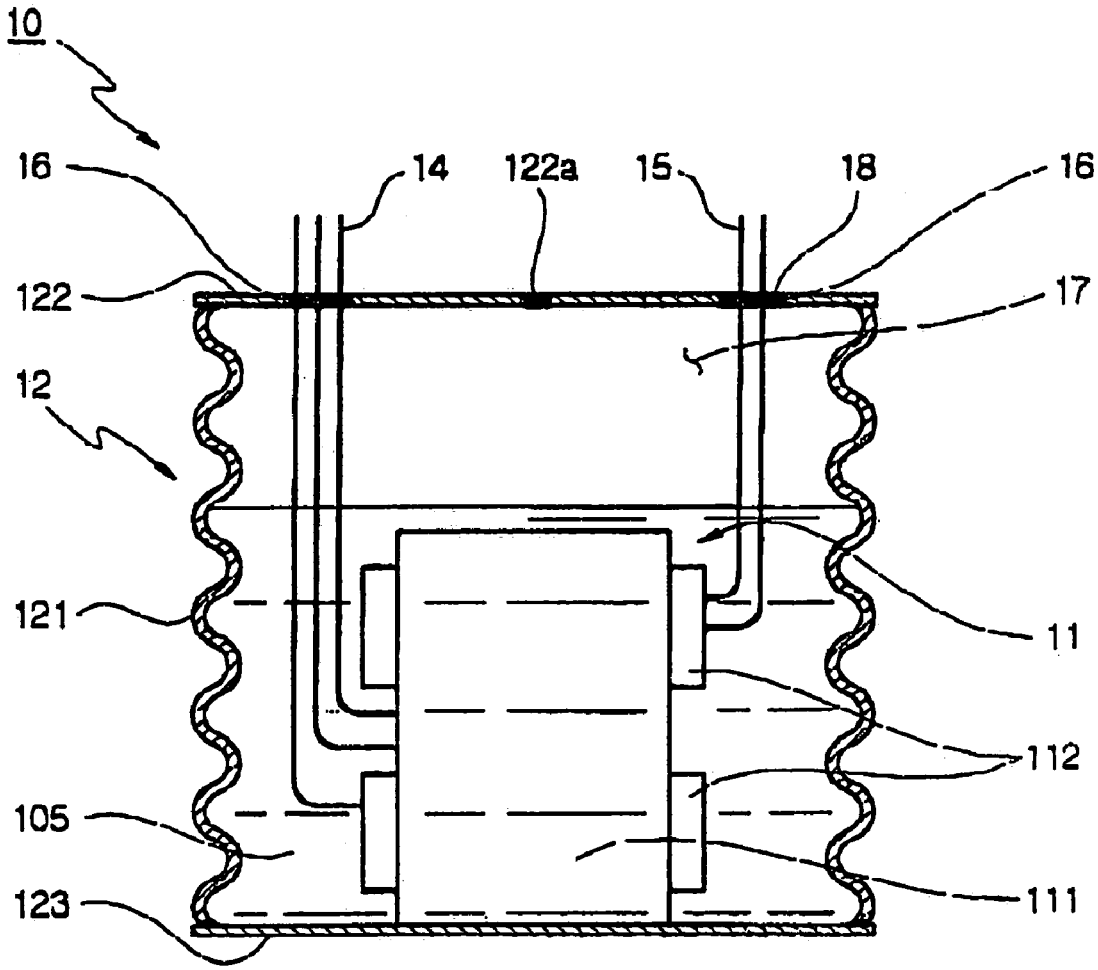
FIG. 1A is a cross-sectional view showing a transformer assembly, according to an embodiment of the present invention.

Hereinafter, an embodiment of the present invention will be described in detail with reference to the attached drawings, wherein the like reference numerals refer to the like elements throughout. The present invention may, however, be embodied in many different forms and should not be construed as being limited to the embodiment set forth herein. Rather, this embodiment is provided so that the present disclosure will be thorough and complete, and will fully convey the concept of the invention to those skilled in the art.

FIG. 1A shows a transformer assembly 10 according to an embodiment of the present invention. As shown in FIG. 1A, the transformer assembly 10 includes a transformer 11 having a core 111 and coils 112 wound around the core 111, and a container 12 receiving the transformer 11 therein. The coils 112 include a lower primary winding connected to an electric power source and an upper secondary winding for outputting current transformed by electromagnetic induction caused by the lower primary winding. The container 12 is hermetically sealed, and includes a base plate 123 on which the transformer 11 is fixedly mounted, and an enveloping part coupled to the base plate 123 to cover the transformer 12. The enveloping part includes a wall body 121 defining side surfaces of the container 12 and a top plate 122. The tubular wall body 121 is shaped as a cylinder or as a polygon, and has corrugated surface s to efficiently radiate heat and accommodate thermal expansion. The corrugated surface has at least two points having different distances from the center of the container 12. That is, the wall body 121 efficiently radiates resistance heat generated from the coils 112 and resistance heat generated by eddy current on the core 111 during operation of the transformer 11.

Although the container 12 may be made of copper or aluminum, which have excellent properties for efficiently radiating heat generated from the transformer 11 and for moldability, aluminum is lower in cost and weight.

The container 12 contains non-conductive oil 105 as a liquid for cooling the transformer 11 housed within the container 12. Although any type of oil may be used as the non-conductive oil 105 serving as the cooling liquid, mineral oil minimizes environmental pollution and harmful effects on the human body. There is no requirement to use oil as the cooling liquid. Non-conductive liquid other than oil, and colloidal materials such as sols or gels, may be used as the cooling liquid. The cooling liquid, such as the non-conductive oil and the colloidal material, is considerably advantageous in that the cooling liquid absorbs vibration and noise generated from the transformer 11, thereby reducing vibration and noise transmitted outside the transformer 11 during operation of the transformer 11.

The non-conductive oil 105 is supplied to the container 12 such that a heating portion of the transformer 11 is submerged in the oil. Accordingly, the oil 105 must be supplied to the container 12 in an amount sufficient to submerge the coils 112 in the oil 105, and both the coils 112 and the core 111 may be submerged in the oil. The amount of the oil 105 is reduced as much as possible while maintaining cooling efficiency for the transformer 11 by supplying the oil 105 to a level between, for example, the upper end of the core 111 and the upper end of the upper coil 112. The space 17 above the oil 105 is maintained in a vacuum state.

The top plate 122 has an oil inlet 122*a* to allow the oil 105 to be injected into the container 12. The oil inlet 122*a* is needed for injection of the oil 105 into the container 12 when both the base plate 123 and the top plate 122 are coupled to the wall body 121 before placing the oil 105 in the container 12. However, when the oil 105 is injected into the container 12 before the top plate 122 is coupled to the wall body 121 and the base plate 123 is coupled to the wall body 121, the oil inlet 122*a* is dispensable.

The transformer 11 has input lines 14 for supplying external low-voltage electric power to the transformer 11, and output lines 15 for outputting current transformed by electromagnetic induction. In the embodiment shown in FIG. 1A, the input lines 14 and the output lines 15 are connected to the transformer 11 in the container 12 through the top plate 122. More specifically, the input lines 14 are connected to the primary winding of the coils 112, and the output line 15 are connected to the secondary winding of the coils 112. Therefore, the container 12 has through holes 16 to allow the input lines 14 and the output lines 15 to enter the container 12 therethrough. The through holes 16 are formed at the top plate 122 of the container 12, for example. Because the oil 105 contained in the container 12 must be prevented from leaking by maintaining an airtight condition within the container 12, the through holes 16, through which the input lines 14 and the output lines 15 respectively pass, are sealed with epoxy resin 18 to prevent the oil 105 from leaking from the container 12 and to make the container 12 airtight.

Figure 1B:
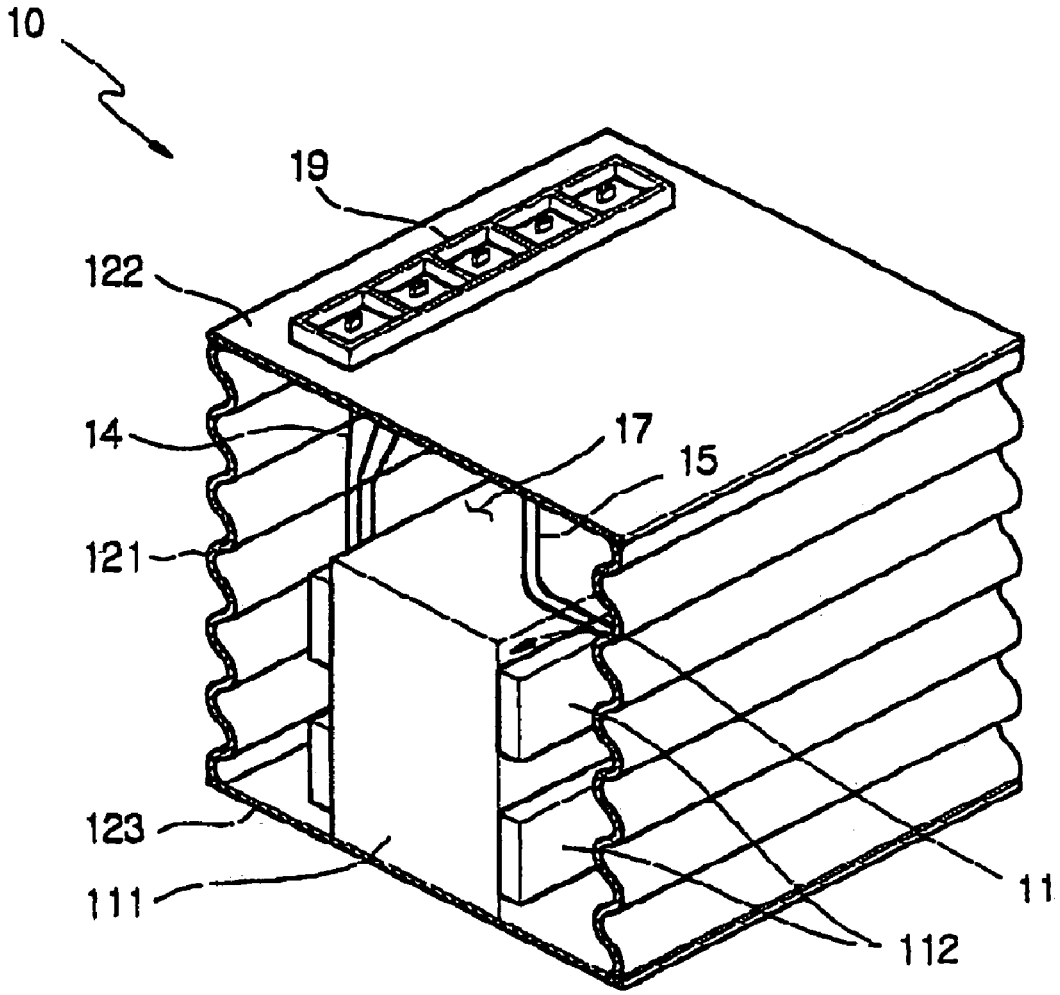
FIG. 1B is a perspective view showing the transformer assembly of FIG. 1A.

FIG. 1B shows the transformer assembly 10 according to an aspect of the present invention in which the top plate 122 of the container 12 has a terminal unit 19 to allow the input lines 14 and the output lines 15 to be connected to an external electric power source and to a magnetron (not shown), respectively. The terminal unit 19 allows the inside and the outside of the top plate 122 of the container 12 to be electrically connected to each other while maintaining the airtightness of the container 12. Accordingly, the transformer assembly 10 according to the aspect of the invention shown in FIG. 1B is more advantageous than the transformer assembly 10 according to the aspect of the invention shown in FIG. 1A because there is no necessity to perform an additional epoxy sealing procedure.

The transformer assembly 10 according to an embodiment of the present invention, which is cooled by the cooling material 105, has been described heretofore with reference to FIGS. 1A and 1B. A structure for mounting the transformer assembly 10 on a microwave oven is now described with reference to FIGS. 2A through 3C.

FIGS. 2A through 2D show structures for mounting the transformer assembly 10, as shown in FIGS. 1A and 1B, on a bottom plate 118 via a bracket 20-23.

Figure 2A:
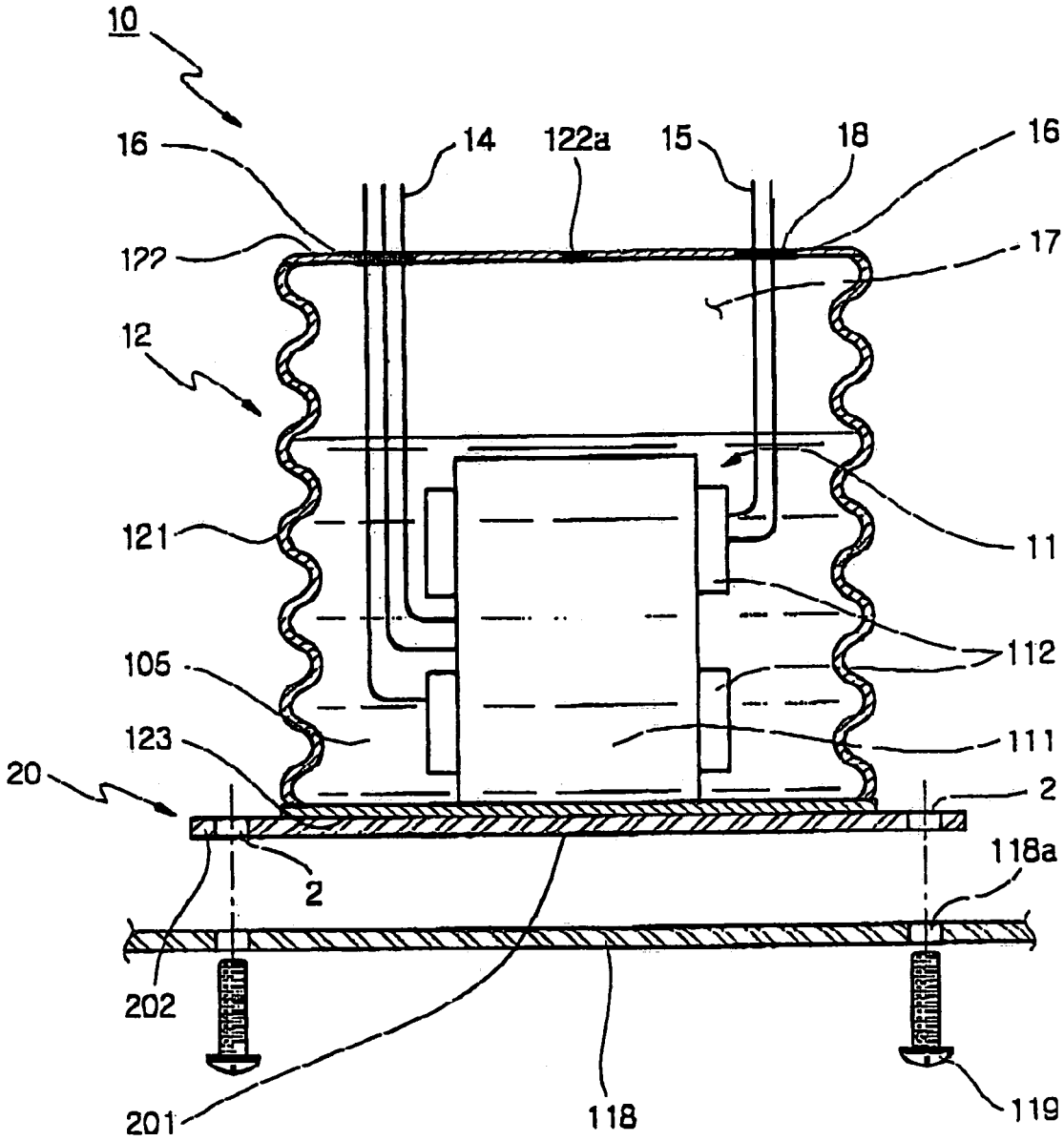
Figure 28:
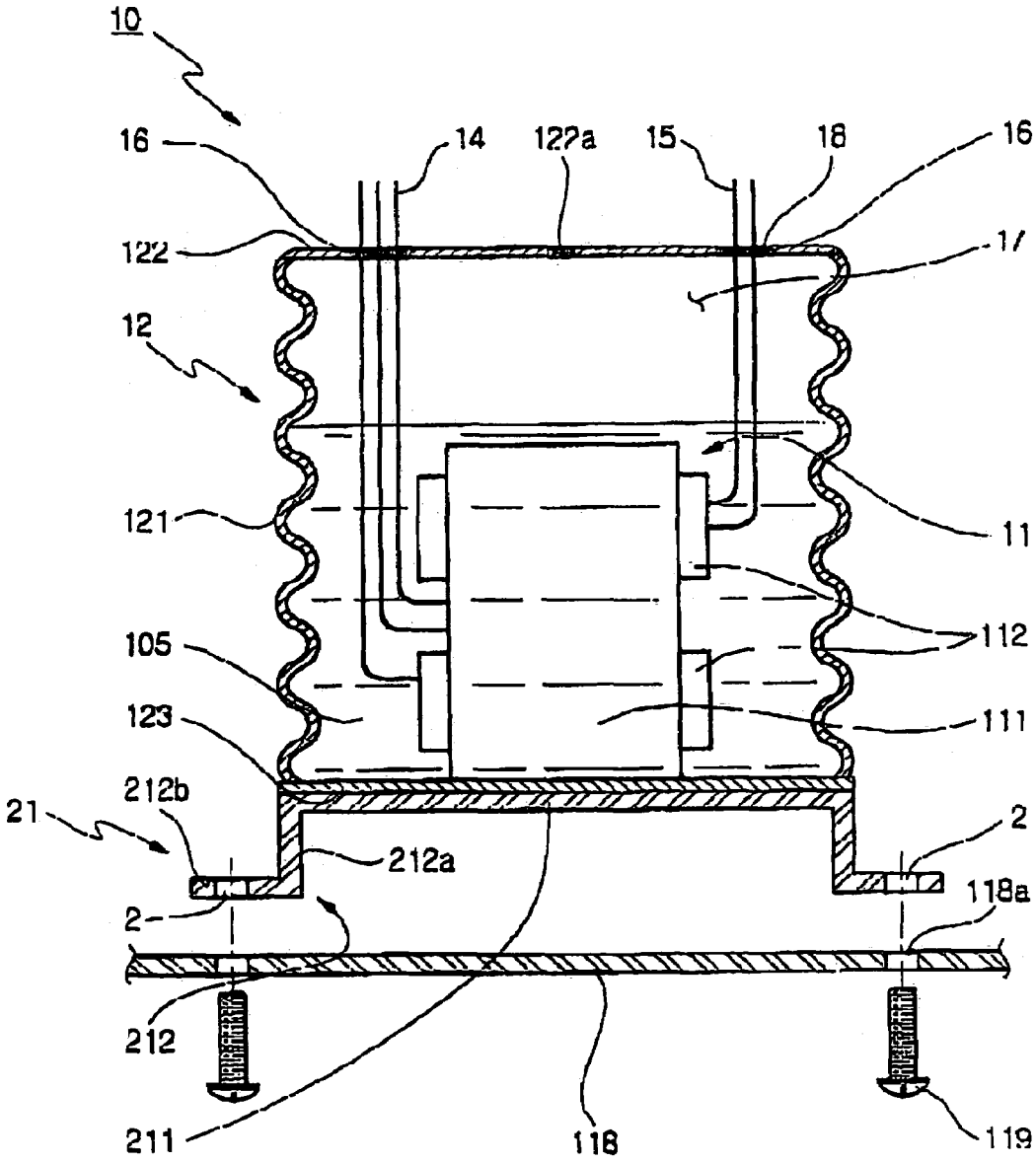

FIG. 2A shows a bracket 20 for mounting the transformer assembly 10 on the bottom plate 118. The bracket 20 includes a base part 201 closely attached to the base plate 123 of the container 12, and mounting parts 202 outwardly extended from the ends of the base part 201. The mounting parts 202 are mounted on the bottom plate 118 of an electrical components area (not shown) of the microwave oven by a fastening unit. More specifically, the mounting parts 202 of the bracket 20 and the bottom plate 118 of the electrical components area of the microwave oven respectively have screw holes 2 and 118*a* and are fastened to each other using screws 119.

Figure 2C:
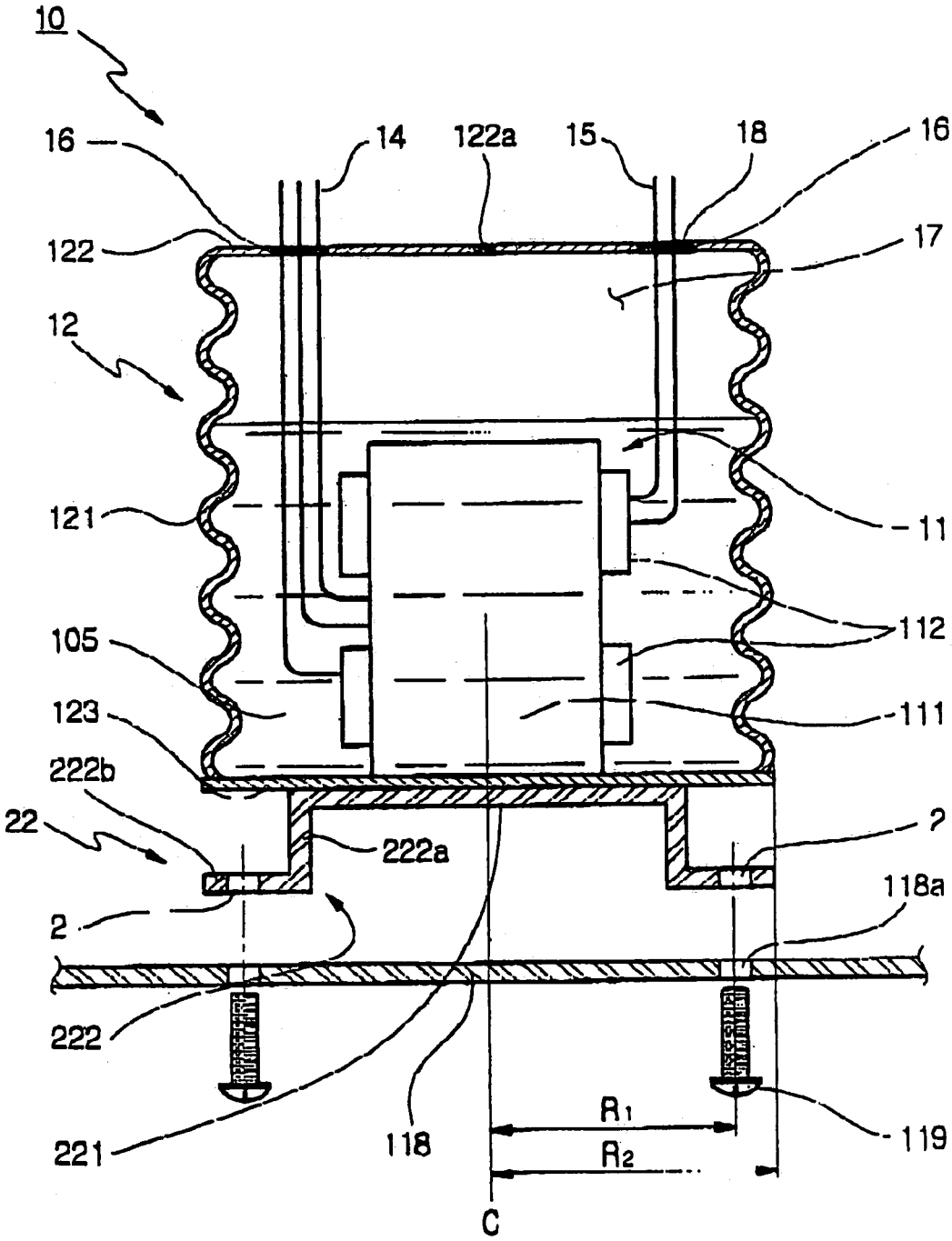

Referring to FIGS. 2B and 2C, there are shown other brackets 21 and 22 for mounting the transformer assembly 10 on the bottom plate 118 of the electrical components area. The brackets 21 and 22 respectively include base parts 211 and 221 fixedly attached to the base plate 123 of the container 12, and mounting parts 212 and 222 having extension portions 212*a* and 222*a* downwardly bent at the peripheral edges of the base parts 211 and 221 and extended downwardly, and fastening portions 212*b* and 222*b* outwardly bent at ends of the extension portions 212*a* and 222*a* with a spacing between the fastening portions 212*b* and 222*b* and the base parts 211 and 221 and fastened to the bottom plate 118 of the electrical components area. The fastening portions 212*b* and 222*b* are formed with screw holes 2 to allow the fastening portions 212*b* and 222*b* to be fastened to the bottom plate 118 using screws 119. As shown in FIG. 2C, the fastening portions 212*b* and 222*b* are positioned under the wall body 121 of the container 12. That is, assuming that a distance between the center line "C" of the transformer 11 and a fastening point of the fastening portion 222*b* is R1, and a distance between the center line "C" of the transformer 11 and the wall body 121 is R2, R1 is less than R2. The mounting parts 202 and 212 FIGS. 2A and 2B occupy additional side space in addition to the space under the transformer assembly 10. Thus, the bracket 22 of FIG. 2C is advantageous in that the space in the electrical components area can be efficiently used, and the size of the electrical components area can be reduced, thereby allowing miniaturization of the microwave oven.

Figure 2D:
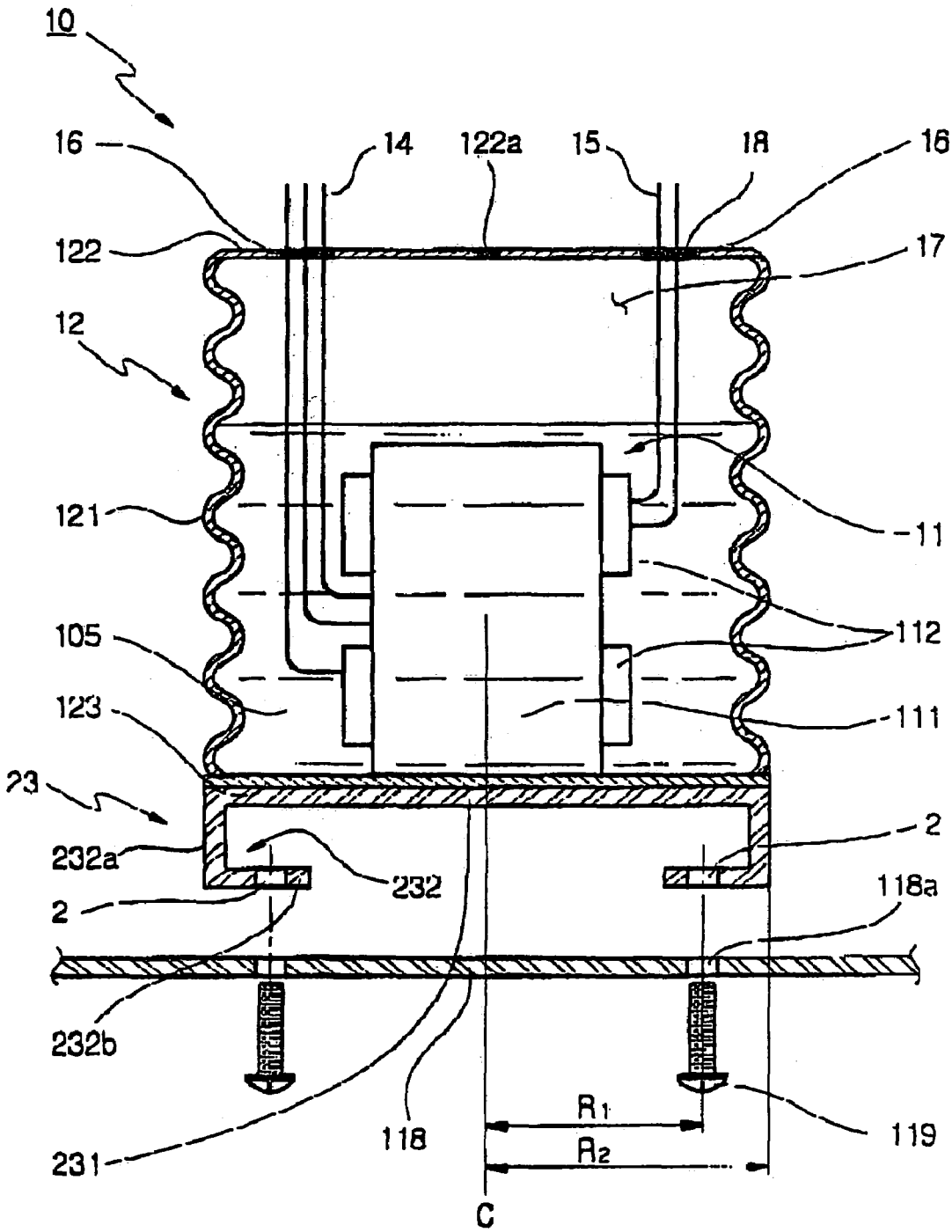

FIG. 2D shows another bracket 23. The bracket 23 includes a base part 231 fixedly attached to the base plate 123 of the container 12, and mounting parts 232 having extension portions 232*a* downwardly bent at the peripheral edges of the base part 231 and extended downwardly, and fastening portions 232*b* inwardly bent at ends of the extension portions 232*a*, with a spacing between the fastening portion 232*b* and the base part 231, and fastened to the bottom plate 118 of the electrical components area. Accordingly, the transformer assembly 10 of FIG. 2D has the same advantage as that of the transformer assembly 10 shown in FIG. 2C. That is, because a distance R1 between the center line "C" of the transformer 11 and a fastening point of the fastening portion 232*b* is less than a distance R2 between the center line "C" of the transformer 11 and the wall body 121, the fastening points at which the bracket 23 is fastened to the bottom plate 118 of the electrical components area using screws 119 are positioned under the wall body 121 of the transformer assembly 10, thereby reducing the space required to install the transformer assembly 10 in the electrical components area.

Although joining of the fastening portions 212*b*, 222*b*, and 232*b* of the transformer assemblies 10 and the bottom plate 118 of the electrical components area is easily achieved using the screw holes 2 and 118*a* and screws 119 in the embodiments shown in FIGS. 2A through 2D, the joining may be achieved by other appropriate ways such as using bolts, rivets, and welding.

Figure 3A:
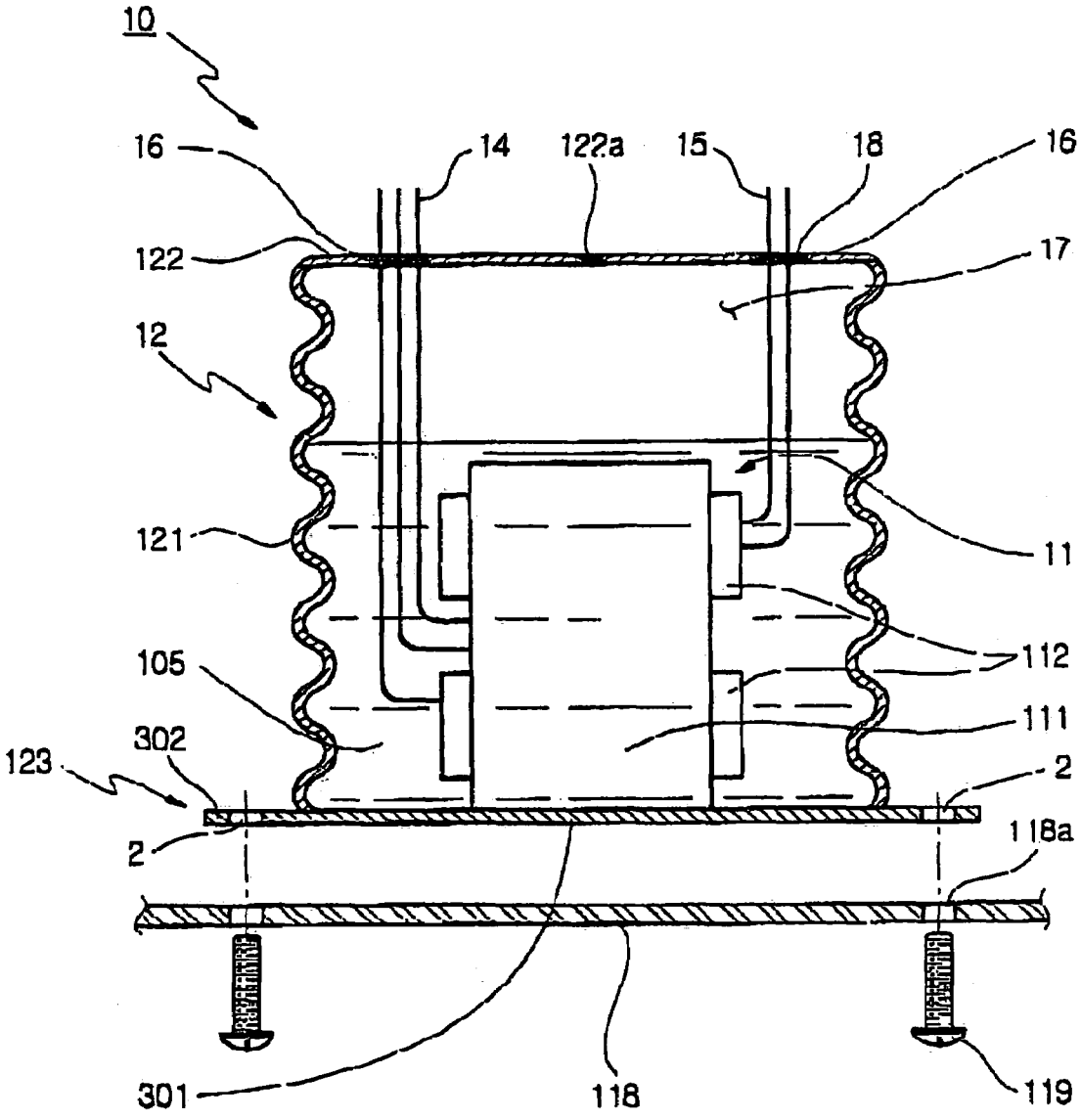
Figure 3B:
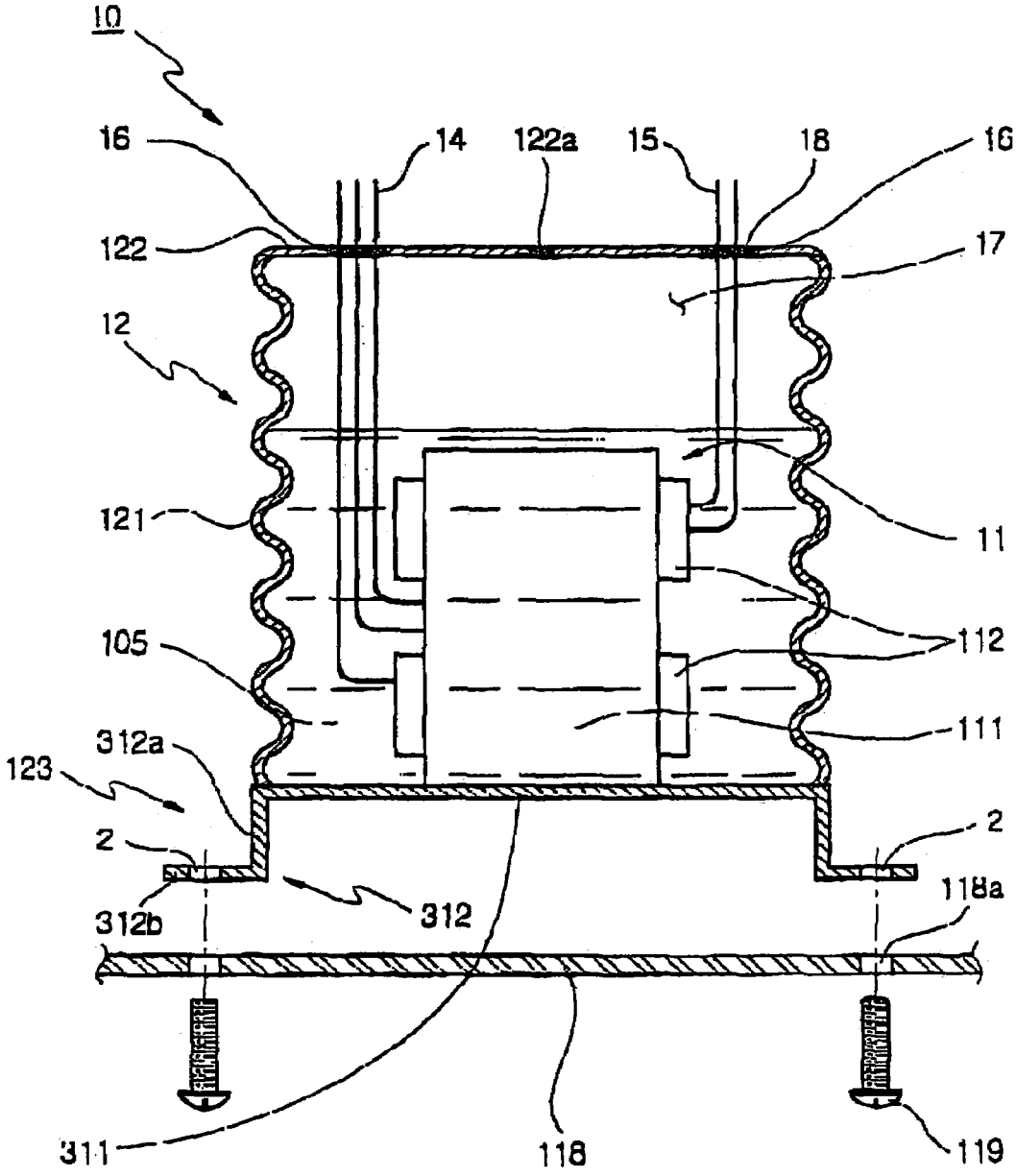
Figure 3C:
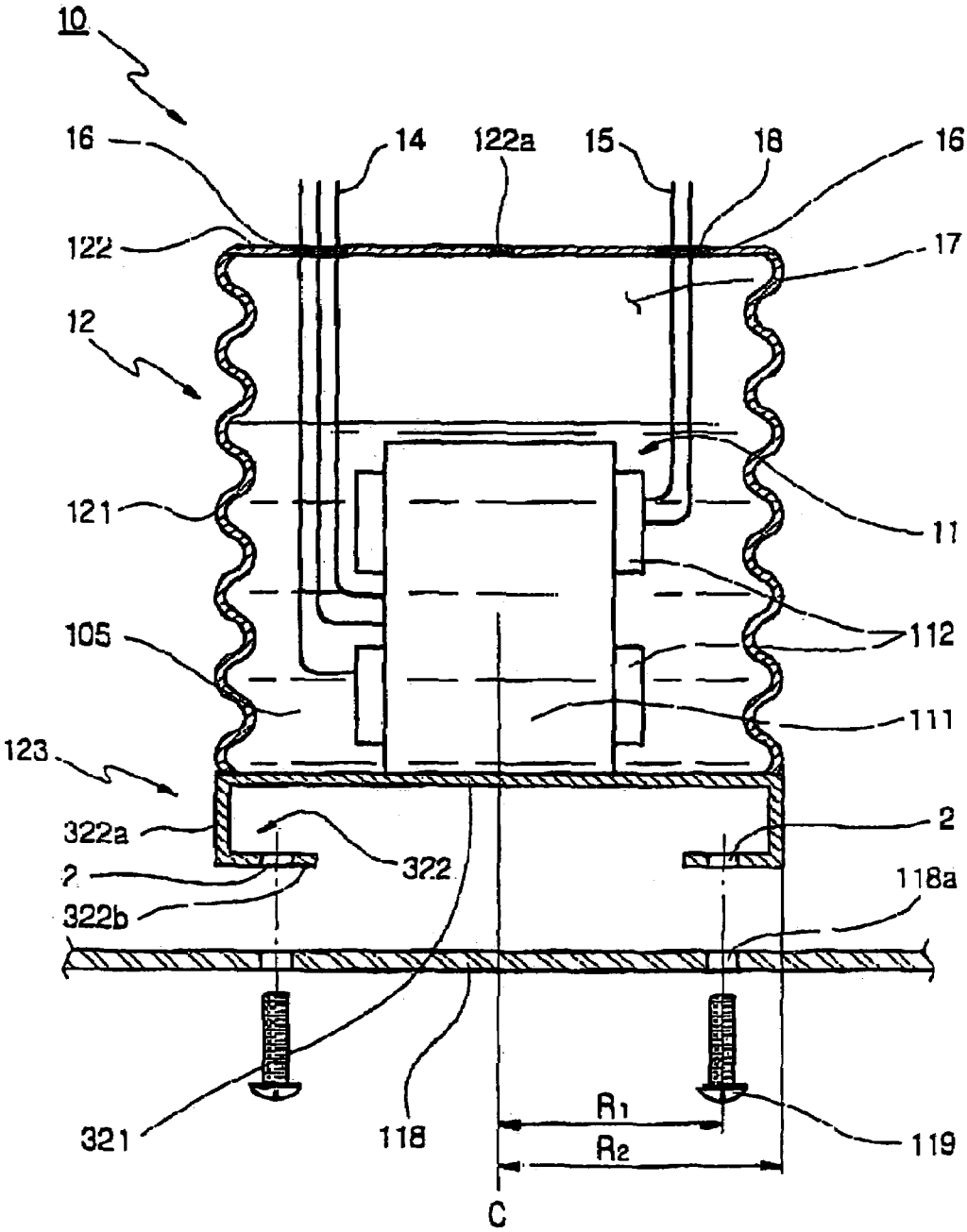

Referring to FIGS. 3A through 3C, there are shown transformer assemblies 10 according to other aspects of the present invention in which the base plate 123 of the container 12 serves as a bracket to mount the transformer assembly 10 on the bottom plate 118 of the microwave oven.

In the transformer assembly 10 shown in FIG. 3A, the base plate 123 includes a base part 301 serving as a bottom of the container 12, and mounting parts 302 outwardly extended from the base part 301 beyond the wall body 121 of the container 12 and having screw holes 2 to allow the mounting part 302 to be joined to the bottom plate 118 of the electrical components area using screws 119.

In the transformer assembly 10 shown in FIG. 3B, the base plate 123 includes a base part 311 serving as a bottom of the container 12, and mounting parts 312 having extension portions 312*a* downwardly bent at the peripheral edges of the base part 311 and extended downwardly, and fastening portions 312*b* outwardly bent at ends of the extension portions 312*a*, with a spacing between the fastening portions 312*b* and the base part 311, and fastened to the bottom plate 118 of the electrical components area.

In the transformer assembly 10 shown in FIG. 3C, the base plate 123 includes a base part 321 serving as a bottom of the container 12, and mounting parts 322 having extension portions 322*a* downwardly bent at the peripheral edges of the base part 321 and extended downwardly, and fastening portions 322*b* inwardly bent at ends of the extension portions 322*a*, with a spacing between the fastening portions 322*b* and the base part 321, and fastened to the bottom plate 118 of the electrical components area. Like the brackets 22 and 23 shown in FIGS. 2C and 2D, because a distance R1 between the center line "C" of the transformer 11 and a fastening point of the fastening portion 322*b* is less than a distance R2 between the center line "C" of the transformer 11 and the wall body 121, the fastening points at which the base plate 123 is fastened to the bottom plate 118 of the electrical components area are positioned inwardly from the wall body 121 of the transformer assembly 10, thereby reducing the space required to install the transformer assembly 10 in the electrical components area and, thus, allowing miniaturization of the microwave oven.

In the transformer assembly 10 in which the base plate 123 of the container 12 serves as a bracket, as shown in FIGS. 3A through 3C, the base plate 123 coupled to the wall body 121 of the container 12 is directly joined to the bottom plate 118 of the electrical components area, unlike the transformer assembly 10 shown in FIGS. 2A through 2D, in which the bracket 20, 21, 22, and 23 is attached to the base plate 123 of the container 12 and then joined to the bottom plate 118 of the electrical components area. Accordingly, because the base plate 123 of the container 12 is directly joined to the bottom plate 118 by a single procedure, reduction of cost of material and simplification of the production process are achieved, thereby improving productivity.

Figure 4A:
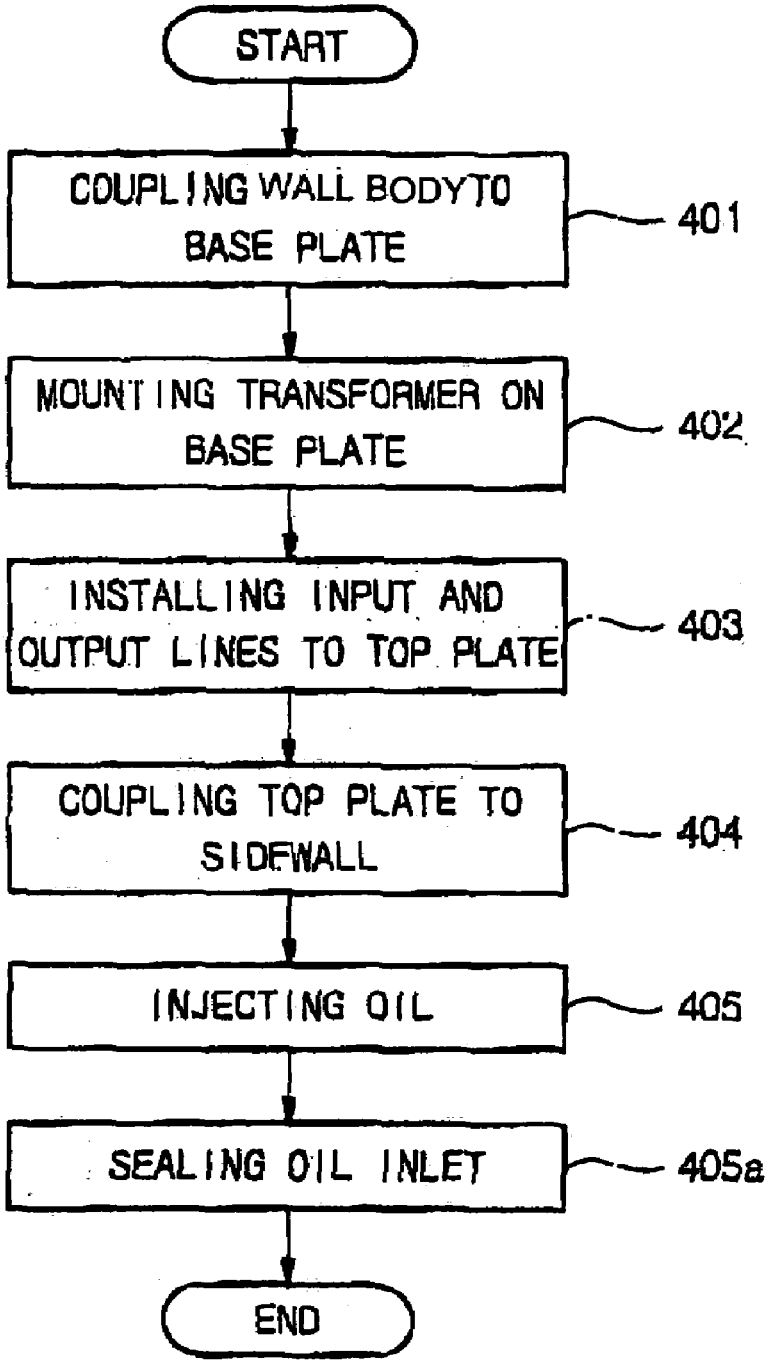
FIG. 4A is a flowchart showing a process of manufacturing the transformer assembly.
Figure 48:
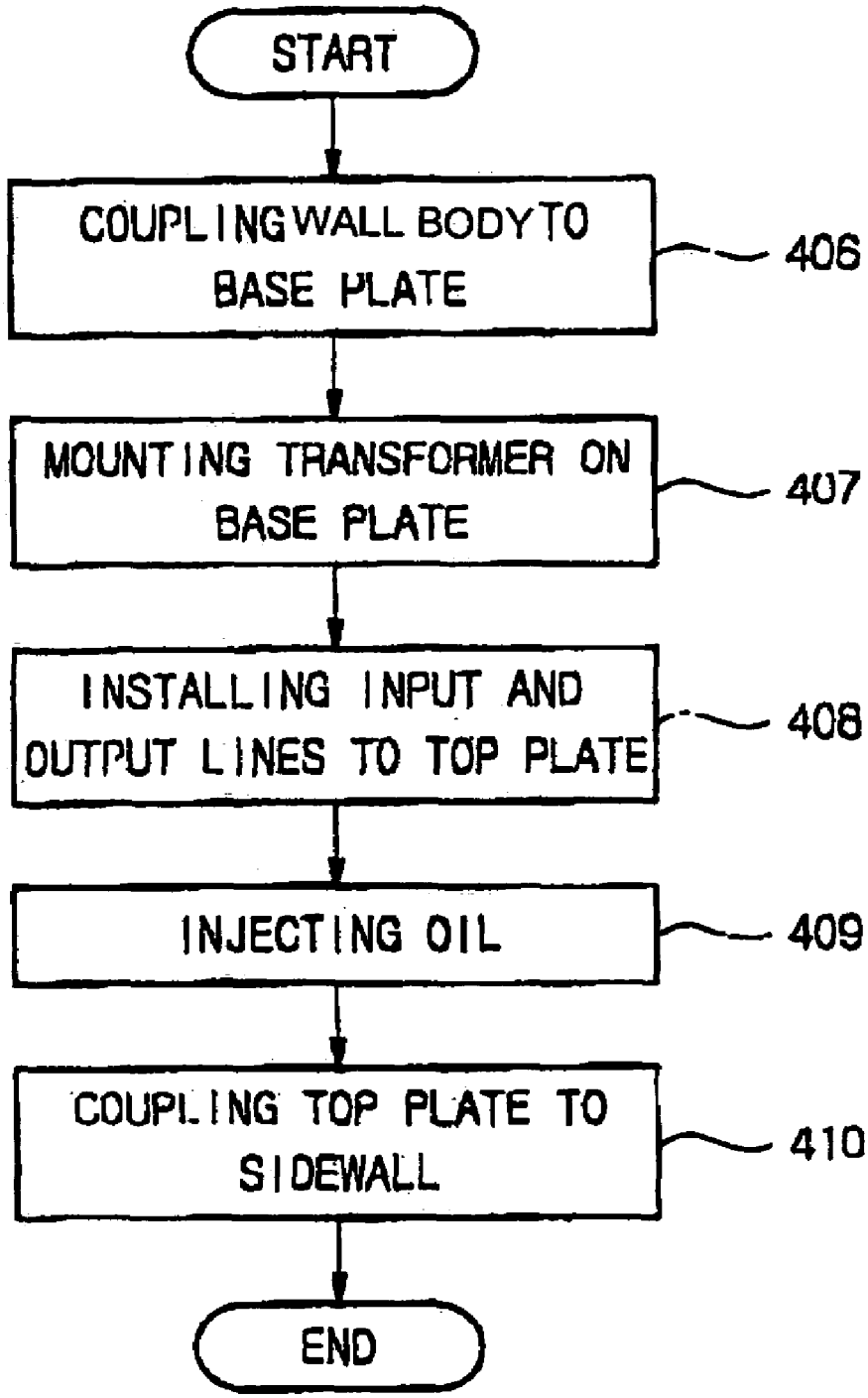

FIGS. 4A and 4B are flowcharts showing processes of manufacturing the transformer assembly 10 according to the present invention.

In a process of manufacturing the transformer assembly as shown in FIG. 4A, the wall body 121 is first coupled to the base plate 123 of the container 12 at operation 401. The transformer 11 is mounted on the base plate 123 at operation 402. Thereafter, input lines 14 for supplying external electric power to the transformer 11, and output lines 15 for outputting current transformed by the transformer 11, are installed on the top plate 122 at operation 403. The top plate 122 is coupled to the wall body 121 at operation 404 to define the container 12, and oil 105 is injected into the container 12 at operation 405.

In particular, operation 401, in which the wall body 121 is coupled to the base plate 123 is performed by a brazing process to assure the prevention of leakage of the oil 105 and the sealing ability of the container 12. The wall body 121 has a corrugated surface to increase the radiating surface thereof. More specifically, the tubular wall body 121, which includes a corrugated surface with at least two points having different distances from the center of the container 12, is prepared, and one end of the wall body 121 is coupled to the base plate 123.

The mounting of the transformer 11 on the base plate 123 is carried out by spot welding to assure secure fixation. Where the additional bracket 20, 21, 22, or 23 is required to join the transformer assembly 10 to the base plate 123, as shown in FIGS. 2A through 2D, the transformer 11, the base plate 123, and the bracket 20, 21, 22, or 23 may all be combined together by spot welding. The bracket 20, 21, 22, or 23 is first attached to the base plate 123, and the transformer 11 and the integrated base plate 123 and bracket 20, 21, 22, or 23 are combined together at one time.

At operation 403, when the top plate 122 is formed with through holes 16, installation of the input lines 14 and the output lines 15 on the top plate 122 is performed by introducing the input lines 14 and the output lines 15 into the container 12 through the through holes 16 and sealing the through holes 16 with epoxy resin 18. On the other hand, when the top plate 122 is provided, at an outer surface thereof, with a terminal unit 19, as shown in FIG. 1B, the installation of the input lines 14 and the output lines 15 on the top plate 122 may be performed by connecting the input lines 14 and the output lines 15 to the terminal unit 19.

At operation 405, which injects oil 105 into the container 12, the top plate 122 with the oil inlet 122*a* is prepared, and the oil 105 is injected into the container 12 through the oil inlet 122*a*. After the injection of the oil 105, the oil inlet 122*a* is sealed with epoxy resin 18 to maintain the container 12 in a hermetically sealed condition at operation 405*a*. At this point, the oil 105 is injected into the container 12 such that a level of the injected oil 105 is maintained between the top plate 122 of the container 12 and the upper end of the coils 112 of the transformer 11. That is, because the coils 112 are dominant heating elements among the elements of the transformer 11, the oil 105 is injected such that the coils 112 are completely submerged in the oil 105. Because the core 111 is also a heating element, the oil 105 may be supplied by an amount sufficient to submerge the core 111 in the oil 105. However, the oil 105 is supplied to a certain level between the upper end of the core 111 and the upper end of the coils 112 to reduce the amount of oil 105 as much as possible without deteriorating its cooling efficiency.

In another process of manufacturing the transformer assembly 10 as shown in FIG. 4B, operations 406, 407, and 408 are similar to operations 401, 402, and 403 of FIG. 4A. As shown in FIG. 4B, the wall body 121 is first coupled to the base plate 123 at operation 406, and the transformer 11 is mounted on the base plate 123 at operation 407. The input lines 14 for supplying external power to the transformer 11, and the output lines 15 for outputting the current transformed by the transformer 11 to the magnetron, are installed through the top plate 122 at operation 408. The oil 105 is injected into the container 12 at operation 409, and the top plate 122 is coupled to the wall body 121 at operation 410. According to the manufacturing process shown in FIG. 4B, because the oil 105 is injected into the container 12 before the top plate 122 is coupled to the wall body 121, unlike the process shown in FIG. 4A, it is possible to omit the operation of sealing the oil inlet 122*a*, as well as the operation of forming the oil inlet 122*a* on the top plate 122.

Figure 5:
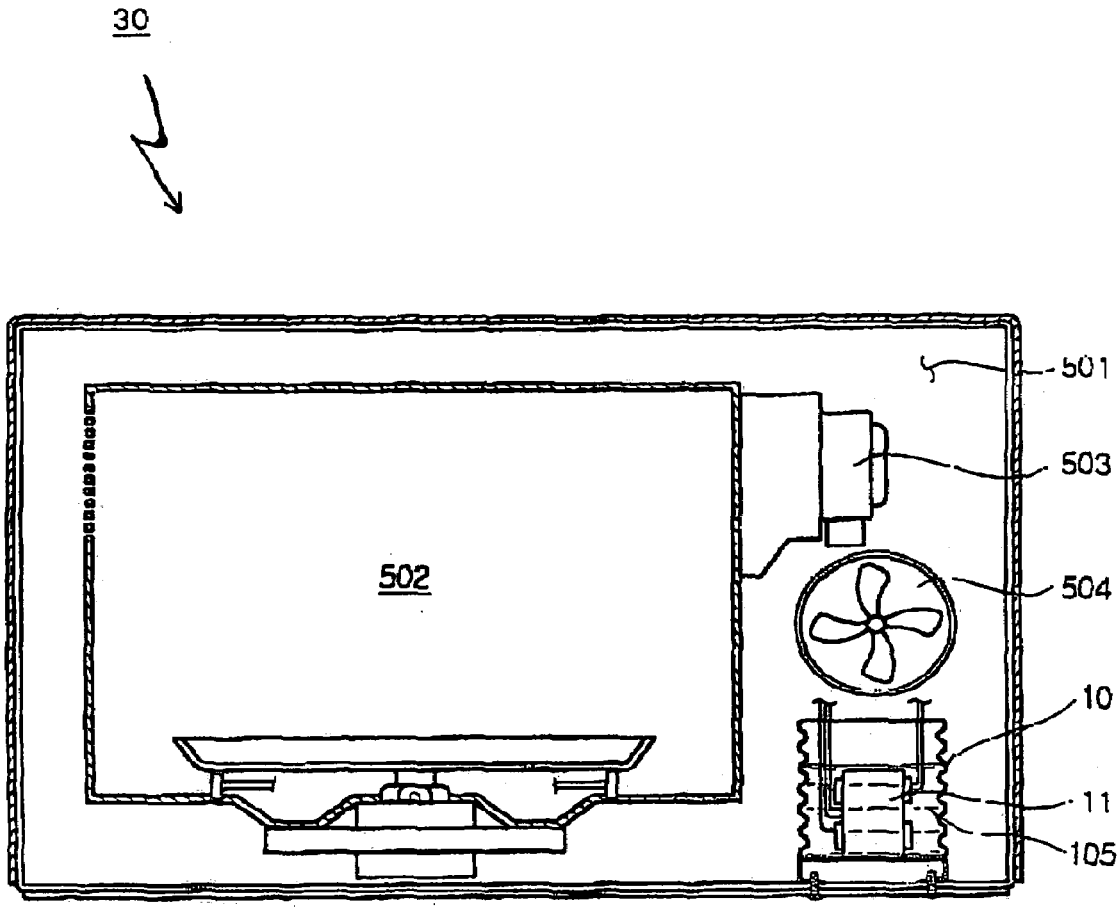
FIG. 5 is a schematic front cross-sectional view of a microwave oven containing the transformer assembly.

FIG. 5 shows a microwave oven 30 with the transformer assembly 10 as described above. More specifically, FIG. 5 shows a microwave oven 30, in which the transformer assembly 10 shown in FIG. 3C is mounted on a bottom plate 118 of an electrical components area 501 of the microwave oven 30. Operation of the microwave oven 30 according to the present invention is described below with reference to FIG. 5. When external commercial power is applied to the transformer 11 to operate the microwave oven 30, electric current, which has been boosted in its voltage by electromagnetic induction, is supplied to a magnetron 503, and the magnetron 503 generates microwaves into a cooking chamber 502. When the microwave oven 30 is operated for an extended period of time, the transformer 11 radiates high-temperature resistance heat generated from the coils 112 and the core 111. The heat radiated from the transformer 11 is immediately absorbed into mineral oil 105 contained in the container 12 of the transformer assembly 10 and then convected to the container 12, thereby causing the heat to be transmitted to the container 12. Because the wall body 121 of the container 12 has a large radiating area due to its corrugated surface, the container 12 of the transformer assembly 10 is efficiently cooled by external cool air introduced into the machine room 501 by a cooling fan 504. The cooling action for the transformer 11 is quickly and efficiently performed because the transformer 11 is surrounded by mineral oil 105, which serves as an efficient cooling medium. Furthermore, because the heat absorbed by the mineral oil 105 is dispersed throughout the mineral oil 105 by convection of the oil 105 and transmitted to the container 12 having a relatively large radiating area, the heat transmitted to the container 12 can be efficiently and quickly removed by external air blown by the cooling fan 504. Accordingly, even though the transformer 11 may operate for a long period of time due to continuous operation of the microwave oven 30, the transformer 11 maintains a stable and constant output without loss of efficiency.

As is apparent from the above description, the present invention provides a transformer assembly for a microwave oven, which has an improved operational efficiency due to its excellent cooling ability. Consequently, because the sizes of some of the components, such as the core and the coils, can be reduced by the improvement of the operational efficiency, production cost for the transformer assembly can be reduced. In addition, because high-density metal components are omitted and a low-density cooling material and container are used, it is possible to achieve miniaturization and weight reduction of the transformer assembly.

Furthermore, the present invention provides a transformer assembly for a microwave oven, in which a transformer is securely installed in a container and the container is hermetically sealable by an improved assembly structure.

Where non-conductive liquid is used as the cooling material, because the present invention provides an improved structure for efficiently installing a transformer assembly to a microwave oven, an improvement in productivity due to simplification of the assembly operation can be achieved. In addition, because the space required to install the transformer assembly in an electrical components area of a microwave oven is significantly reduced, the remaining space in the machine room can be used for other applications, or the microwave oven can be miniaturized due to a reduction in size of the electrical components area.

According to the present invention, because oily or colloidal material is used as the cooling material, vibration and noise of the transformer can be reduced, thereby improving reliability of products using the transformer assembly.

Although a few aspects of the present invention have been shown and described, it would be appreciated by those skilled in the art that changes may be made in these aspects without departing from the principles and spirit of the invention, the scope of which is defined in the claims and their equivalents.

What is claimed is:

1. A transformer assembly for a microwave oven having a magnetron, comprising:

a transformer to apply voltage to the magnetron of the microwave oven;

a container receiving the transformer therein and having a base plate coupled to the microwave oven and a cover body coupled to the base plate, the cover body having an undulating sinuous shaped surface; and a cooling material contained in the container to cool the transformer.

2. The transformer assembly of claim 1, wherein the cooling material is mineral oil.

3. The transformer assembly of claim 1, wherein the container has an inner surface with at least two points having different distances from a center of the container.

4. The transformer assembly of claim 1, wherein the container is made of aluminum or copper.

5. The transformer assembly of claim 1, wherein the transformer and the base plate are attached to each other by spot welding.

6. The transformer assembly of claim 1, wherein the cover body and the base plate are attached to each other by brazing.

7. The transformer assembly of claim 1, further comprising:

an input line;

an output line;

a primary winding of the transformer connected to an external power source via the input line;

a secondary winding of the transformer to output electric current, transformed by electromagnetic induction induced by the primary winding, to the magnetron via the output line; and a terminal unit attached to the cover body to allow the input line and the output line to be connected to the external power source and the magnetron, respectively.

8. The transformer assembly of claim 7, wherein the terminal unit has block terminals.

9. A transformer assembly for a microwave oven having a magnetron, comprising:

a transformer to apply voltage to the magnetron of the microwave oven;

a container receiving the transformer therein and having a base plate coupled to the microwave oven and a cover body coupled to the base plate; and a cooling material contained in the container to cool the transformer, wherein the base plate comprises:

a base part defining a bottom of the container;

extension parts at respective ends of the base part, formed by bending each end of the base part downwardly; and mounting parts at respective ends of the extension parts, formed by bending the end of each extension part outwardly with the base part being separated from the mounting parts, to fasten the base plate to the microwave oven.

10. A transformer assembly for a microwave oven having a magnetron, comprising:

a transformer to apply voltage to the magnetron of the microwave oven;

a container receiving the transformer therein and having a base plate coupled to the microwave oven and a cover body coupled to the base plate; and a cooling material contained in the container to cool the transformer, wherein the base plate comprises:

a base part defining a bottom of the container;

extension parts at respective ends of the base part, formed by bending each end of the base part downwardly; and mounting parts at respective ends of the extension parts, formed by bending the end of each extension part inwardly with the base part being separated from the mounting parts, to fasten the base plate to the microwave oven.

11. A transformer assembly for a microwave oven having a magnetron, comprising:

a transformer to apply voltage to the magnetron of the microwave oven;

a container receiving the transformer;

a cooling material contained in the container to cool the transformer; and a bracket attached to a surface of the container to install the container in the microwave oven, the surface of the container comprising a plurality of sinuous shaped undulations to increase a surface area thereof so that a majority of heat emitted by the transformer is emitted to an outside of the container through the surface.

12. The transformer assembly of claim 11, wherein the transformer, the surface of the container, and the bracket are attached to one another by spot welding.

13. The transformer assembly of claim 11, wherein the container comprises a base plate and a cover body coupled to the base plate by brazing.

14. The transformer assembly of claim 11, further comprising:

an input line;

an output line;

a primary winding of the transformer connected to an external power source via the input line;

a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

15. The transformer assembly of claim 14, wherein the terminal unit has block terminals.

16. A transformer assembly for a microwave oven having a magnetron, comprising:

a transformer to apply voltage to the magnetron of the microwave oven;

a container receiving the transformer;

a cooling material contained in the container to cool the transformer; and a bracket attached to a surface of the container to install the container in the microwave oven, wherein the bracket comprises:

a base part attached to the surface of the container;

extension parts at respective ends of the base part, formed by bending each end of the base part downwardly; and mounting parts at respective ends of the extension parts, formed by bending the end of each extension part outwardly with the base part being separated from the mounting parts, to fasten the bracket to the microwave oven.

17. A transformer assembly for a microwave oven having a magnetron, comprising:

a transformer to apply voltage to the magnetron of the microwave oven;

a container receiving the transformer;

a cooling material contained in the container to cool the transformer; and a bracket attached to a surface of the container to install the container in the microwave oven, wherein the bracket comprises:

a base part attached to the surface of the container;

extension parts at respective ends of the base part, formed by bending each end of the base part downwardly; and mounting parts at respective ends of the extension parts, formed by bending the end of each extension part inwardly with the base part being separated from the mounting parts, to fasten the bracket to the microwave oven.

18. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container receiving the transformer and having a base plate and a cover body having multiple sinuous shaped undulations to increase a surface area thereof and coupled to the base plate; and a cooling material contained in the container to cool the transformer.

19. The microwave oven of claim 18, wherein the cooling material is mineral oil.

20. The microwave oven of claim 18, wherein the container has an inner surface with at least two points having different distances from a center of the container.

21. The microwave oven of claim 18, wherein the container is made of aluminum or copper.

22. The microwave oven of claim 18, wherein the transformer and the base plate are attached to each other by spot welding.

23. The microwave oven of claim 18, wherein the cover body and the base plate are attached to each other by brazing.

24. The microwave oven of claim 18, further comprising:

an input line;

an output line;

a primary winding of the transformer connected to an external power source via the input line;

a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

25. The microwave oven of claim 24, wherein the terminal unit has block terminals.

26. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container receiving the transformer and having a base plate and a cover body coupled to the base plate; and a cooling material contained in the container to cool the transformer, wherein the base plate comprises:

a base part defining a bottom of the container;

extension parts at respective ends of the base part, formed by bending each end of the base part downwardly; and mounting parts at respective ends of the extension parts, formed by bending the end of each extension part outwardly with the base part being separated from the mounting parts, to fasten the base plate to the microwave oven.

27. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container receiving the transformer and having a base plate and a cover body coupled to the base plate; and a cooling material contained in the container to cool the transformer, wherein the base plate comprises:

a base part defining a bottom of the container;

extension parts at respective ends of the base part, formed by bending each end of the base part downwardly; and mounting parts at respective ends of the extension parts, formed by bending the end of each extension part inwardly with the base part being separated from the mounting parts, to fasten the base plate to the microwave oven.

28. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container having a cover body with sinuous shaped undulations receiving the transformer;

a cooling material contained in the container to cool the transformer while remaining within the container; and a bracket attached to a surface of the container to install the container in the machine room.

29. The microwave oven of claim 28, wherein the transformer, the surface of the container, and the bracket are attached to one another by spot welding.

30. The microwave oven of claim 28, wherein the container comprises a base plate and a cover body coupled to the base plate by brazing.

31. The microwave oven of claim 28, further comprising:

an input line;

an output line;

a primary winding of the transformer connected to an external power source via the input line;

a secondary winding of the transformer to output electric current, transformed by electromagnetic induction caused by the primary winding, to the magnetron via the output line; and a terminal unit attached to the cover body to allow the input line and the output line to be connected to the external power source and the magnetron, respectively.

32. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container receiving the transformer;

a cooling material contained in the container to cool the transformer; and a bracket attached to a surface of the container to install the container in the machine room, wherein the bracket comprises:

a base part attached to the surface of the container;

extension parts at respective ends of the base part, formed by bending each end of the base part downwardly; and mounting parts at respective ends of the extension parts, formed by bending the end of each extension part outwardly with the base part being separated from the mounting parts, to fasten the bracket to the microwave oven.

33. A microwave oven, comprising:

a cooking chamber;

an electrical components area isolated from the cooking chamber;

a magnetron installed in the electrical components area to generate microwaves into the cooking chamber;

a transformer to apply voltage to the magnetron;

a container receiving the transformer;

a cooling material contained in the container to cool the transformer; and a bracket attached to a surface of the container to install the container in the machine room, wherein the bracket comprises:

a base part attached to the surface of the container;

extension parts at respective ends of the base part, formed by bending each end of the base part downwardly; and mounting parts at respective ends of the extension parts, formed by bending the end of each extension part inwardly with the base part being separated from the mounting parts, to fasten the bracket to the microwave oven.

34. A microwave oven, having an electrical components area comprising:

a transformer assembly having a transformer, a container receiving the transformer, and a cooling material hermetically sealed in the container to cool the transformer; and a fastening unit connected to the transformer assembly to install the transformer assembly in the electrical components area of the microwave oven, wherein a distance between a center line of the container and a center line of the fastening unit is less than a distance between the center line of the container and an outer circumferential surface of the container.

35. The microwave oven of claim 34, wherein the container comprises:

a base part defining a bottom of the container;

extension parts at respective ends of the base part, formed by bending each end of the base part downwardly; and mounting parts at respective ends of the extension parts, formed by bending the end of each extension part outwardly with the base part being separated from the mounting parts, wherein the fastening unit fastens the mounting parts to a bottom of the electrical components area.

36. The microwave oven of claim 35, wherein the transformer assembly has a bracket attached to a surface of the container, the bracket comprising:

a base part attached to the surface of the container;

extension parts at respective ends of the base part, formed by bending each end of the base part downwardly; and mounting parts at respective ends of the extension parts, formed by bending the end of each of the extension parts with the base part being separated from the mounting part, wherein the fastening unit fastens the mounting part to a bottom of the electrical components area.

* * * * *

UNITED STATES PATENT AND TRADEMARK OFFICE

CERTIFICATE OF CORRECTION

PATENT NO. : 7,253,383 B2
APPLICATION NO. : 10/691595
DATED : August 7, 2007
INVENTOR(S) : Park It is certified that error appears in the above-identified patent and that said Letters Patent is hereby corrected as shown below:

On the title page item (56), Column 2 (Other Publications), Line 1, below "U.S. Appl. No. l0/690,660, filed Oct. 23, 2003, Heui Seag Park." insert --Patent Abstract of Japan for Japanese Publication No. 11-16740, Published 01/22/1999.--.

Signed and Sealed this

Fourteenth Day of April, 2009

John Doll

JOHN DOLL
*Acting Director of the United States Patent and Trademark Office*